United States Patent [19]

Halley

[11] 4,046,070

[45] Sept. 6, 1977

[54] ROTARY PRINTING PRESSES

[75] Inventor: Angus Murray Halley, Birmingham, England

[73] Assignee: James Halley & Sons Limited, West Bromwich, England

[21] Appl. No.: 613,751

[22] Filed: Sept. 16, 1975

Related U.S. Application Data

[63] Continuation of Ser. No. 462,766, April 22, 1974, abandoned.

[51] Int. Cl.[2] ..... B47F 9/15

[52] U.S. Cl. ..... 101/216; 101/153

[58] Field of Search ..... 101/150, 152, 153, 212, 101/216, 219

[56] References Cited

U.S. PATENT DOCUMENTS

| | | | |
|---|---|---|---|
| 2,506,011 | 5/1950 | Caulfield | 101/153 |
| 3,384,012 | 5/1968 | Zernov | 101/216 |
| 3,500,744 | 3/1970 | Lewis | 101/216 X |
| 3,625,145 | 12/1971 | Heatley, Jr. et al. | 101/152 |
| 3,783,782 | 1/1974 | Hardt | 101/216 |

*Primary Examiner*—Edgar S. Burr
*Assistant Examiner*—R. E. Suter
*Attorney, Agent, or Firm*—Norris & Bateman

[57] ABSTRACT

Rotary printing press is provided with mounting means for an image cylinder to facilitate interchange of cylinders of different sizes and their adjustment. The cylinder is carried on upstanding supports on a cradle, end stub shafts of the cylinder being journalled on said supports and one or both of the latter being adjustable longitudinally of the cradle to suit cylinders of various axial lengths. The cradle is movable in a frame of the press either horizontally so that it can be withdrawn as a unit with the cylinder, or vertically for forming a nip with an impression cylinder.

2 Claims, 3 Drawing Figures

ROTARY PRINTING PRESSES

This is a continuation of application Ser. No. 462,766, filed Apr. 22, 1974, now abandoned.

This invention relates to rotary printing presses with particular, but not exclusive, reference to direct (i.e. non-offset) printing onto continuous web material.

The object of the invention is to provide improved mounting means for a printing (image bearing) cylinder of a rotary press (hereinafter referred to as the image cylinder) which facilitates interchange of cylinders, even if the cylinders are of different axial length, e.g. to accommodate webs or other materials of different widths; yet which provide accurate and secure operative positioning of said cylinders.

According to the invention there is provided a rotary printing press of the kind in which an image cylinder is operatively positioned directly below an impression cylinder to form a nip through which the material to be printed is operatively fed, characterised by a mounting cradle comprising a transverse beam, and a pair of upstanding supports located on the beam, at least one of which is selectively movable longitudinally thereof for adjustment of their relative spacing, each support having a bearing formation for receiving a respective journal of the image cylinder and said cradle being selectively movable in a frame of the press for positioning the image cylinder so journalled in operative relation to the impression cylinder.

Preferred embodiments of the invention are now more particularly described with reference to the accompanying drawings wherein.

Figure 1:
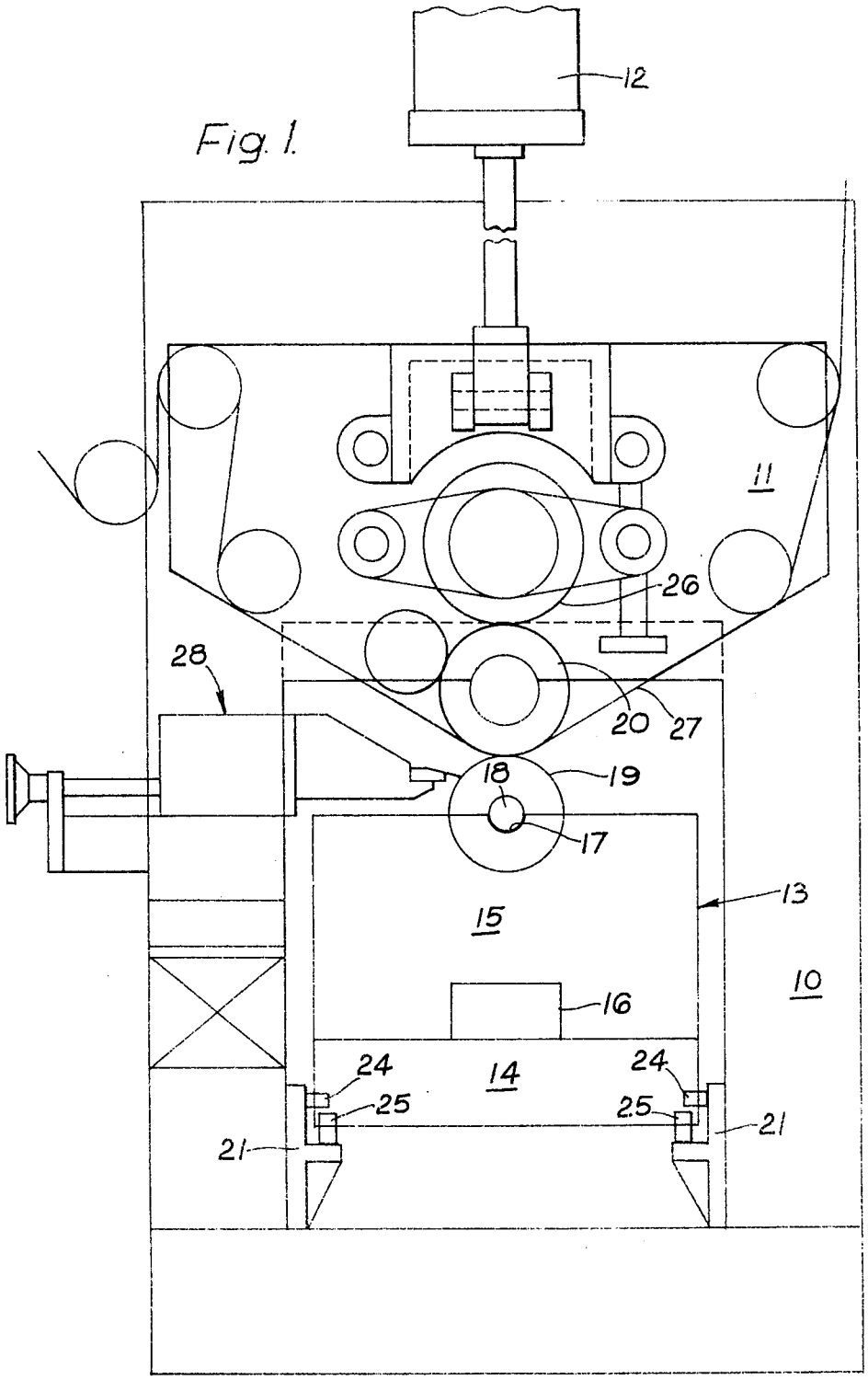
FIG. 1 is a diagrammatic side elevation of a rotary printing press incorporating the invention.

Referring to FIG. 1, a rotary press for printing web material comprises a fixed frame 10, an impression cylinder carrier 11 extending transversely within the frame and which can be raised and lowered by fluid pressure rams 12, and an image cylinder cradle 13 which locates operatively within the lower part of the frame.

Figure 2:
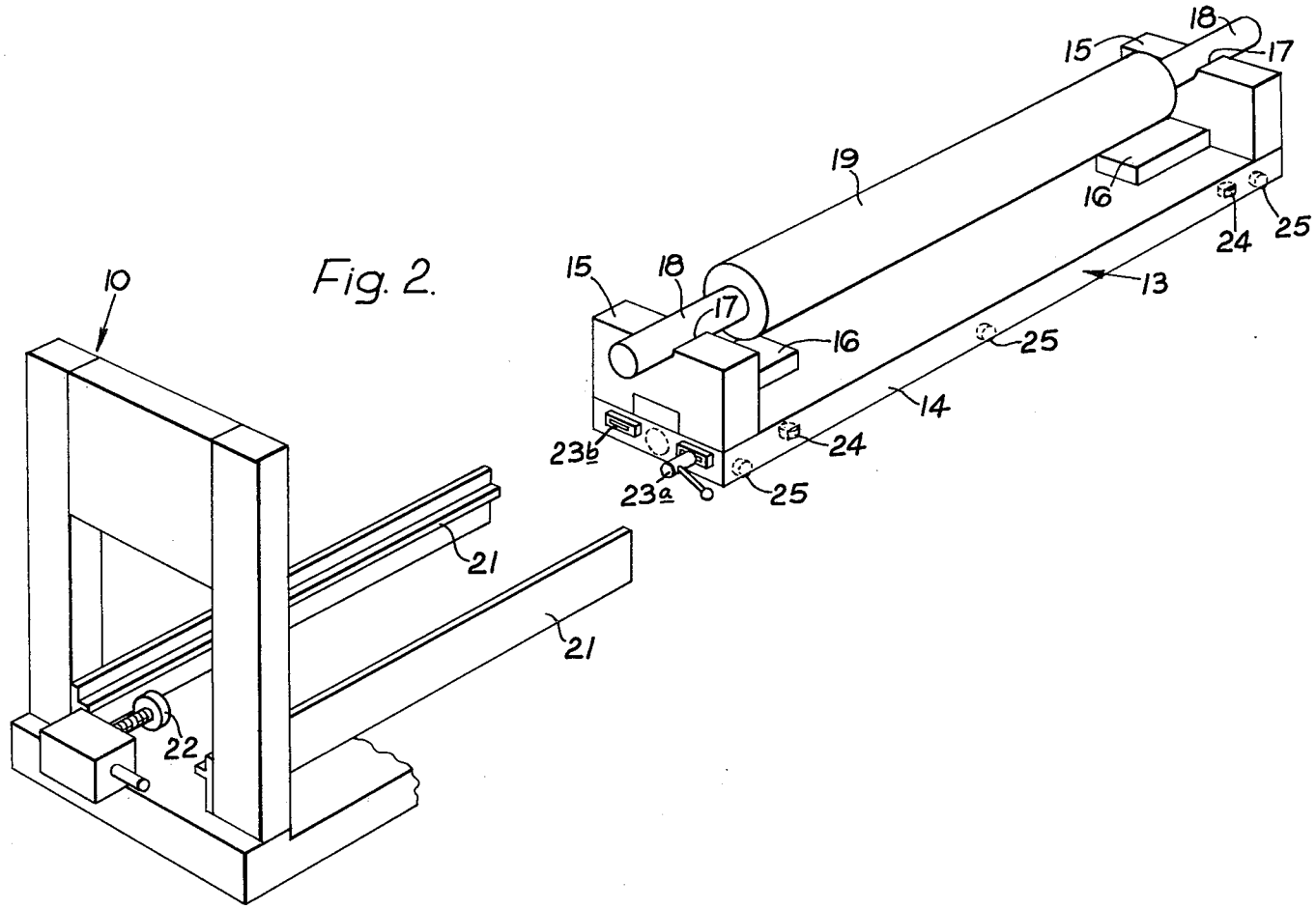
FIG. 2 is a diagrammatic perspective view of an image cylinder mounting cradle and associated structure of the press.
Figure 3:
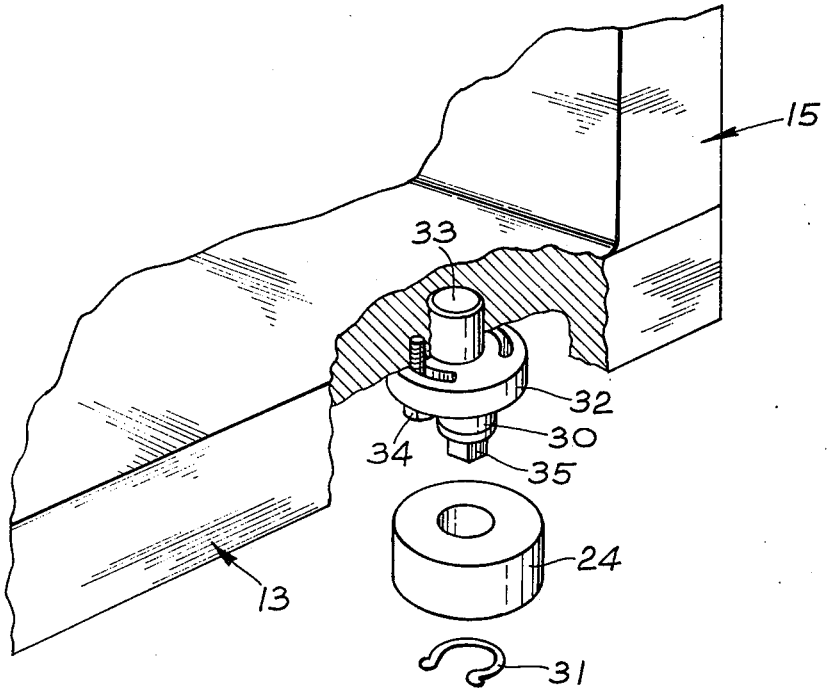
FIG. 3 is a fragmentary exploded view partly sectioned showing an eccentric mounting for a cradle side roller.

Cradle 13 is shown in detail in FIG. 2 in a position withdrawn from frame 10. Said cradle comprises a transverse beam 14 to extend the full width of frame 10 and a pair of upstanding support members 15 in sliding engagement with longitudinal guide rails 16 on the top face of beam 14 so that their relative spacing and their position relative to the centre line of the press can be independently adjusted. Clamping means are provided, for example bolts engaging in T-slots (not shown) in beam 14, to secure members 15 at the desired position, beam 14 may conveniently bear graduation marks for their accurate positioning.

Each support 15 defines an upwardly open semi-circular bearing formation 17 (FIG. 2) which operatively receives bearing journals 18 of stub shafts at opposite ends of an image cylinder 19 of the press. Journals 18 may consist of standard roller or ball race assemblies, the inner races being secured on the respective stub shafts and the outer races resting in the formations 17.

In this way a range of image cylinders having different axial lengths can be readily accommodated, e.g. for printing various widths of web, appropriate adjustment of members 15 ensuring that cylinder 19 is accurately located in operating relationship to an impression cylinder 20 located by carrier 11. In an alternative construction one only of the members 15 is longitudinally adjustable on beam 14, the other support member being fixed. In this case the shorter length cylinders will be accommodated off-center of the press.

In its operative position cradle 13 locates on slide means in the form of parallel transverse rails 21 of frame 10 and is adjustably positioned longitudinally by adjustable locating means in the form of a screw jack 22 (FIG. 2) which is releasably connected to one end of beam 14 by screw clamps **23*a* (one only shown) engaging in slots 23*b* on one end of beam 14. Lateral location of cradle 13 is provided by side rollers 24 on beam 14 which engage flanges of rails 21. Said rollers may be mounted on eccentric shafts. FIG. 4 shows, by way of example, a mode of mounting rollers 24. Each side roller 24 is freely rotatable on a stub shaft 30 on which it is retained by a spring clip 31, the shaft being releasably fixed to an undersurface of cradle 13 as by an integral flange 32 having a central locating spigot 33. Flange 32 is clamped as by screws 34 engaged in segmental slots permitting limited angular movement about the axis of spigot 33. The axis of shaft 30 is offset so as to be eccentric to spigot 33 enabling adjustment of the later positioning of cradle 13 between rails 21 to be made by altering the operative position of the rollers 24 by slackening screws 34 and rotating the mounting to the desired degree as by means of a squared outer end 35 on shaft 30. Carriage 14 has further rollers 25 on its underface to facilitate movement along rails 21 when released from jack 22**.

Impression cylinder carrier 11 mounts a single backup roll 26 journalled directly above and in peripheral contact with impression cylinder 20 so that the axes of roll 26, and both cylinders 20 and 19 lie in a common vertical plane, impression cylinder 20 being operatively urged downwardly to form a nip with image cylinder 19 by the operation of rams 12, a web 27 being fed through said nip in conventional manner for printing, image cylinder 19 being fed with ink from a conventional inking system and doctored by a mechanism 28 which may be mounted on the frame 10 of the press, or possibly carried on the cradle 12.

When it is desired to service or replace image cylinder 19 the nip pressure is removed by raising carrier 11, and cradle 13 is freed by releasing clamps **23*a*. The entire cradle 13 with cylinder 19 carried thereon can then be withdrawn from frame 10 by movement along rails 21** to the position shown in FIG. 2 where it may be received onto a trolley for facilitating subsequent handling.

1. A rotary printing press having a frame and an image cylinder positioned on said frame in an operative position aligned directly below an impression cylinder, said impression cylinder being so mounted on the frame as to be selectively movable between a non-functioning position spaced above said image cylinder and an operative position where it cooperates with the operatively positioned image cylinder for forming a nip through which material to be printed may be fed, said press including a mounting cradle for said image cylinder comprising an elongate horizontal beam and a pair of upstanding supports on the beam, at least one of said supports being movable longitudinally of said beam for adjustment of the relative spacing of said supports and each support having bearing means rotatably mounting a respective end of the image cylinder; opposed horizontal slide means on said frame and extending transversely thereof on which said cradle is supported and along which said cradle is selectively movable in a direction parallel to the axis of rotation of the image cylinder for insertion into said frame for operatively positioning the image cylinder mounted thereon and for removal from said frame; locator means on opposite sides of the cradle adapted for engagement with and movement along substantially vertical longitudinal formations of the slide means to positively locate the cradle laterally of the slide means; and clamping means for releasable endwise connection of the cradle to the frame to positively maintain the cradle longitudinally of the slide means in the operative position of said image cylinder, said slide means comprising horizontally spaced rails along which the cradle is movable, said substantially vertical longitudinal formations being upright flanges on said rails, said locator means comprising rotatable side rollers on the cradle peripherally engaging said flanges, and at least some of said side rollers being eccentrically mounted for selectively adjustable positive location of the cradle laterally of the rails.

2. A printing press according to claim 1, wherein said rails are each provided with horizontal surfaces, and said cradle is supported on the rails by rollers rotatable about horizontal axes and peripherally engaging said horizontal surfaces.

* * * * *